United States Patent [19]

Fernström

[11] Patent Number: 4,986,714

[45] Date of Patent: Jan. 22, 1991

[54] VEHICLE ELEVATOR AND CONVEYOR ARRANGEMENT

[75] Inventor: Göran Fernström, Norsborg, Sweden

[73] Assignee: Sky Park AB, Stockholm, Sweden

[21] Appl. No.: 435,468

[22] PCT Filed: Apr. 13, 1989

[86] PCT No.: PCT/SE89/00205

§ 371 Date: Dec. 5, 1989

§ 102(e) Date: Dec. 5, 1989

[87] PCT Pub. No.: WO89/09866

PCT Pub. Date: Oct. 19, 1989

[30] Foreign Application Priority Data

Apr. 14, 1988 [SE] Sweden ..... 8801396

[51] Int. Cl.[5] ..... E04H 6/18

[52] U.S. Cl. ..... 414/256; 414/240; 414/241; 414/260; 414/262; 414/264

[58] Field of Search ..... 414/231, 233, 234, 239, 414/240, 241, 242, 245, 246, 244, 253, 254, 255, 256, 259, 260, 262, 264

[56] References Cited

U.S. PATENT DOCUMENTS

| | | | |
|---|---|---|---|
| 1,584,212 | 5/1925 | Burrell | 414/240 |
| 2,598,750 | 6/1952 | Bargehr | 414/262 X |
| 3,224,605 | 12/1965 | Buzzanca | 414/253 X |
| 4,170,310 | 10/1979 | Bajulaz | 414/241 |
| 4,733,760 | 12/1988 | Valli | 414/254 |

FOREIGN PATENT DOCUMENTS

| | | | |
|---|---|---|---|
| 1434625 | 10/1968 | Fed. Rep. of Germany | 414/240 |
| 2258848 | 6/1974 | Fed. Rep. of Germany | 414/239 |
| 1167565 | 11/1958 | France | 414/255 |
| 0219261 | 9/1989 | Japan | 414/246 |

*Primary Examiner*—Frank E. Werner

*Assistant Examiner*—John V. VandenBosche

*Attorney, Agent, or Firm*—Nies, Kurz, Bergert & Tamburro

[57] ABSTRACT

A vehicle elevator and conveyor arrangement in a parking building of the kind in which the vehicle is intended to be conveyed in the building without the assistance of a driver. The conveyor arrangement includes a so-called transfer carriage which is intended to raise and lower all wheel of the vehicle and which can be moved in a horizontal plane in the building and also in a vertical direction by means of the elevator arrangement, which elevator arrangement includes an elevator platform for supporting a transfer carriage. Each of the stories or floors of the parking building on which a transfer carriage (31) is intended to be moved is provided with two parallel rails (50, 51) which form a horizontal transfer-carriage conveyor path or track (71). One or more elevator shafts (61, 62) are positioned along the longitudinal extension of the rails. The wheel (52–59) of the transfer carriage can be displaced from a position (55') in which the track width of the transfer carriage (31) corresponds to the distance between the running or bearing surfaces of the rails (50,51) to a position (55'') in which the track width is smaller than this distance. The elevator platform includes a plate whose length (L) is shorter than the distance between the rails (50, 51). Lifting attachments project from the elevator platform (40) in the longitudinal direction thereof. The rails (50, 51) are interrupted in the vicinity of respective elevator shafts, so as to allow vertical passage of the lifting attachments. The longitudinal extension of each interruption in the rails (50, 51) is shorter than the axle distance between the wheels (52–59) of each wheel pair of the transfer carriage (31), so that a transfer carriage is able to pass an elevator shaft in the horizontal direction.

6 Claims, 3 Drawing Sheets

VEHICLE ELEVATOR AND CONVEYOR ARRANGEMENT

BACKGROUND OF THE INVENTION

The present invention relates to a vehicle elevator (lift) and conveyor arrangement, particularly for cars, in vehicle parking buildings of the kind in which a vehicle is moved to a parking space without the assistance of a driver.

Examples of such vehicle conveying systems are found described in Swedish Patent Application No. 8605279-2 and Swedish Patent Application No. 8703756-0, the priority applications for U.S. application Ser. No. 223,786, filed July 26, 1988 (now allowed), and International Application PCT/SE88/00583, published as WO88/4350 on June 16, 1988.

The present elevator and conveyor arrangement is intended for use in car parking buildings in which cars are conveyed horizontally and vertically from a ground floor area to a parking space situated in the building, without the aid of a driver and without rolling the car. Such buildings form part of the prior art and include a multiple of floors or stories, each story comprising a plurality of mutually adjacent car parking spaces.

One particular advantage obtained with parking buildings of this kind is that they can be run unmanned, or substantially unmanned. Thus, a driver is able to drive his/her car to a predetermined position in relation to the conveyor arrangement and pay the requisite fee into an automatic pay box, wherewith a ticket is issued which contains information as to the part of the building in which the car will be parked. A computer detects a free parking space, with the aid of sensors, and causes the car to be moved into the space chosen. When collecting the car, the ticket is inserted into a reader in which the information contained on the ticket is read-off, whereafter the computer will activate and control the conveyor system such as to collect the car, subsequent to payment having been made.

A serious problem with such parking systems or arrangements is one of locking the car relative to the conveyor arrangement in a simple and ready fashion, without requiring manual assistance. The problem is accentuated by the fact that different cars have different track widths and also different wheel bases.

This problem has been solved with the vehicle conveyor systems or arrangements taught by the aforesaid two patent specifications. The conveyor systems according to said patent specifications include eight lifting blocks which are intended to be placed in pairs on respective sides of each wheel of the car and therewith cause the wheels to raised or lowered in relation to a supporting surface.

The blocks are movable mounted on a so-called transfer carriage which is operative in moving the car to a parking space.

SUMMARY OF THE INVENTION

The present invention is intended to solve a different problem encountered in parking buildings of this kind, and particularly in multi-story car parks which comprise three or more stories, where each story includes a large number of parking spaces. The provision of a large number of elevator or lift shafts for conveying the transfer carriages between the different stories of the parking building is not desirable.

For instance, two elevator shafts can suffice to serve a multi-story car park comprising six stories with twenty-four parking spaces on each story or floor. Naturally, the number of elevators, or lifts, provided will depend on the total number of parking spaces and the number of stories, which gives the elevator transport time, statistic customer waiting time, etc. One problem, however, is that the elevators should be positioned in relation to the parking spaces on each story such as to minimize the distance travelled by a transfer carriage from a parking space to an elevator and vice-versa. Furthermore, the transfer carriages should be able to move in an optimum fashion on each story or floor, irrespective of the prevailing position of the elevators, so that elevator capacity can be utilized to a maximum.

The present invention relates to an elevator and conveying arrangement which enables a transfer carriage to move freely around a story and therewith even to pass an elevator shaft, irrespective of whether or not an elevator is located on the story in question.

The present invention thus relates to an elevator and conveyor arrangement in vehicle parking buildings, particularly car parking buildings, in which the vehicle is moved to a parking space in the building without the aid of a driver and without rolling the actual vehicle itself, the conveyor arrangement including a so-called transfer carriage which includes a transport carriage which, in turn, includes lifting devices intended for lifting and lowering all the wheels of said vehicle, and in which arrangement the transfer carriage can be moved in a horizontal plane in the parking building and also in a vertical plane with the aid of said elevator arrangement, which arrangement includes an elevator platform for supporting a transfer carriage. The vehicle elevator and conveyor arrangement is characterised in that provided on each of the stories or floors in the parking building to which a transfer carriage is intended to be conveyed are two mutually parallel rails or the like bars which form a horizontal transfer-carriage conveyor path or track and on which respective transfer carriages are conveyed by means of two wheel pairs disposed on each side; in that one or more elevator shafts are located along the longitudinal extension of the rails; in that the transfer carriage wheels are capable of being displaced from a position in which the track width of the transfer carriage corresponds to the distance between the rails to a position in which the track width is smaller than said distance; in that the elevator platform includes a plate whose length is shorter than the distance between the rails and from which plate lifting attachments project in the longitudinal direction of the elevator platform; in that said rails are interrupted in the vicinity of respective elevator shafts so as to permit vertical passage of the lifting attachments; in that the longitudinal extension of each interruption in the rails is shorter than the distance between the axles of the wheels in each of the wheel pairs of the transfer carriage; and in that elevator platform lifting devices are attached to said lifting attachments.

DESCRIPTION OF THE PREFERRED EMBODIMENTS

Figure 1:
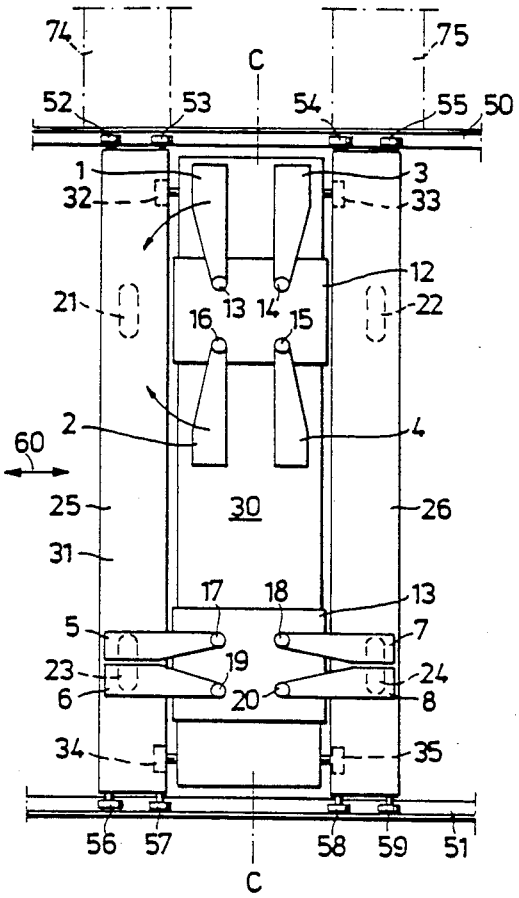
FIG. 1 illustrates schematically a transfer carriage.

FIG. 1 illustrates schematically a transfer carriage which, in principle, is constructed in accordance with the teachings of Swedish Patent Specification 8703756-0. According to this patent specification, first and second pairs of lifting blocks, 1, 2 and 3, 4, are mounted on a first carriage 12. Third and fourth pairs of lifting blocks 5, 6 and 7, 8, are mounted on a second carriage 13.

The carriages 12, 13 are placed on a line C—C, one after the other, along which a vehicle is intended to be driven onto a vehicle supporting surface and positioned above the carriages 12, 13. Each lifting block 1–8 is mounted on one end of an arm, 13–20, and the arms 13–20 are pivotable about an axis, from an inwardly swung or retracted position, in which respective arms 13–20 and lifting blocks 1–8 are parallel with, or substantially parallel with, said line C—C, to an outwardly swung or extended position, which is perpendicular to, or substantially perpendicular to the outwardly swung position. In the extended position, the lifting blocks 1–8 of each pair are located close to one another or in abutment with each other. When seen in vertical section, FIG. 2, the lifting blocks 1–8 have a wedge shape, such that in their extended positions two mutually coacting lifting blocks 1–8 will form an outwardly facing concave surface. Each pair of lifting blocks is intended to be driven from its retracted position to its extended position, such as to insert the lifting blocks beneath a vehicle wheel 21–24, from both sides of the wheel and lift the same.

Figure 3:
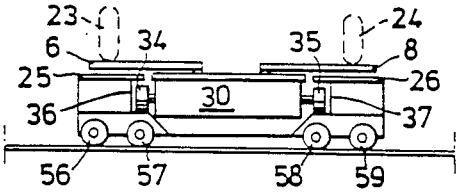
FIG. 3 illustrates the transfer carriage of FIG. 1 schematically, viewed from the lower end of FIG. 1.

With reference to FIGS. 1 and 3, a vehicle is driven onto a vehicle supporting surface, such as a ramp which lies in line with and on the same level as the supporting surfaces 25, 26. Reference has been made in the aforegoing to two carriages 12, 13. The carriages 12, 13 co-act with a transport carriage 30, which in turn is carried by a transfer carriage 31. The transport carriage 30 can be moved in relation to the transfer carriage 31, by means of driven wheels 32–35 which run on rails or like bars, such as U-beams 36, 37 mounted on the transfer carriage 31, see FIG. 3.

The aforesaid two carriages 12, 13 may both be capable of being driven along the transport carriage 30, so as to enable the transfer carriages 12, 13 to be positioned centrally beneath the respective wheel axles of the vehicle. However, it may be sufficient for solely one of the transfer carriages 12, 13 to be drivingly movable in relation to the transport carriage 30 while achieving the same function.

Figure 4:
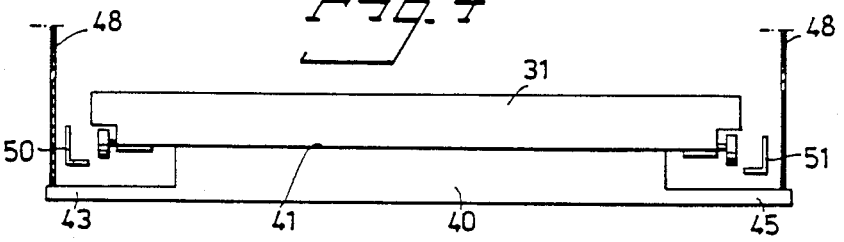
FIG. 4 illustrates schematically an elevator platform on which a transfer carriage rests.

According to the present invention, this transfer carriage forms a part of the vehicle elevator and conveyor arrangement intended for moving the vehicle in the parking building, to and from a parking space therein. The transfer carriage 31 can be moved in a horizontal plane in the parking building. The transfer carriage 31 is also capable of being moved in a vertical direction in said building, with the aid of an elevator arrangement which includes an elevator platform 40, see FIG. 4, for supporting the transfer carriage.

In accordance with the invention, the arrangement also includes two mutually parallel rails 50, 51 or corresponding devices, see inter alia FIG. 1, which form a horizontal transfer-carriage transport path or track. Rails 50, 51 are provided on each story or floor of the parking building on which transfer carriages are intended to be moved.

The transfer carriages 31 are driven on the rails 50, 51 by means of driven wheels, two such wheel pairs 52, 53; 54, 55; 56, 57; 58, 59 being provided on each side of the transfer carriage.

The transfer carriage 31 is movable along the rails 50, 51 in a direction reference 60 in FIG. 1. This direction is perpendicular to the direction of movement of the transport carriage 30 relative to the transfer carriage 31.

Figure 6:
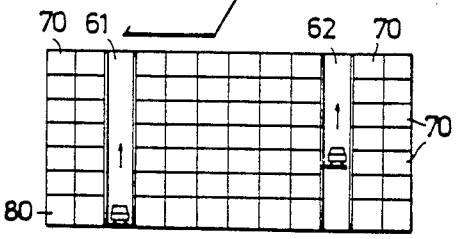
FIG. 6 is a schematic, section view of a parking building taken on the line A—A in FIG. 7.
Figure 8:
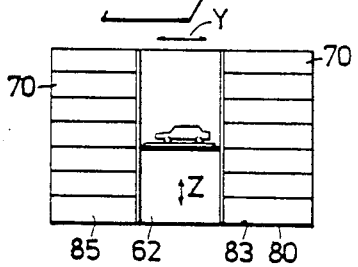
FIG. 8 is a schematic, sectional view of the parking building taken on the line B—B in FIG. 7.
Figure 7:
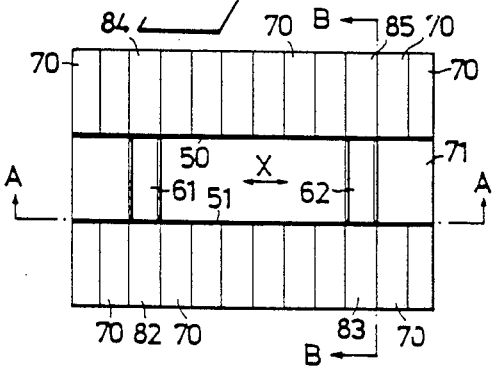
FIG. 7 is a schematic view of a story or floor of the parking building.

FIGS. 6–8 are mutually different views of an exemplifying parking building. The elevator and conveyor arrangement includes one or more elevator shafts 61, 62, see FIG. 6. The elevator shafts extend through a transport path, comprising said rails 50, 51, on each story or floor of the building.

Figure 2:
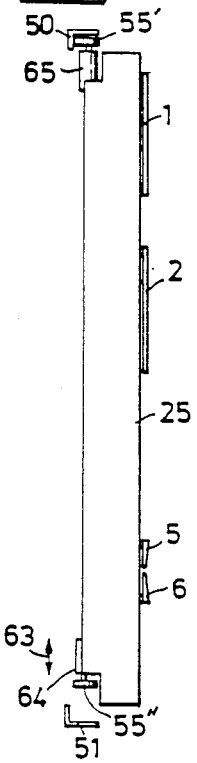
FIG. 2 illustrates the transfer carriage of FIG. 1 schematically from one side.

The wheels 52–59 of the transfer carriage 31 are mounted for displacement, see FIG. 2, from a position 55' (right-hand part of FIG. 2) in which the track width of the transfer carriages corresponds to the distance between the bearing surfaces of the rails 50, 51, to a position 55'' (left-hand part of FIG. 2) in which the track width is smaller than said distance. The axles of the wheels 52–59 can thus be displaced in the directions of the arrow 63, with the aid of suitably know devices 64, 65, such as hydraulic piston-cylinder devices.

The elevator platform 40 includes a plate 41, the size of which corresponds to the size of the transfer carriage 31 when seen in plane view, and the length L of which is smaller than the distance between the rails 50, 51.

Extending from each of the corners of the elevator platform 40, are lifting attachments 42, 43, 44, 45 which extend in the longitudinal direction of the platform.

Figure 5:
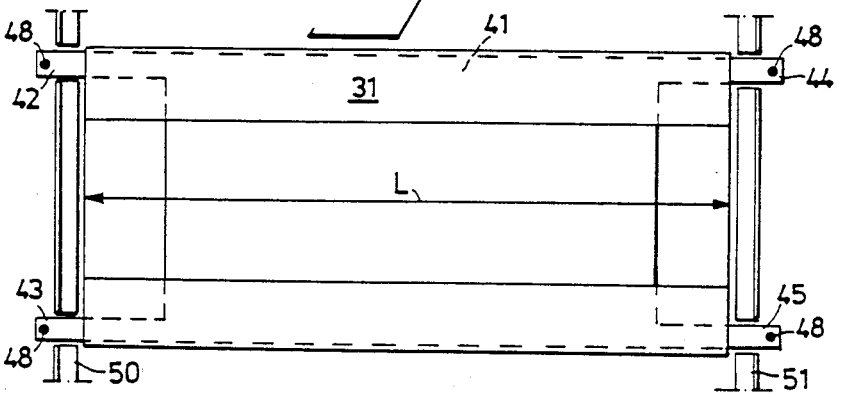
FIG. 5 is a schematical, top plan view of the elevator platform and transfer carriage shown in FIG. 4.
Figure 10:
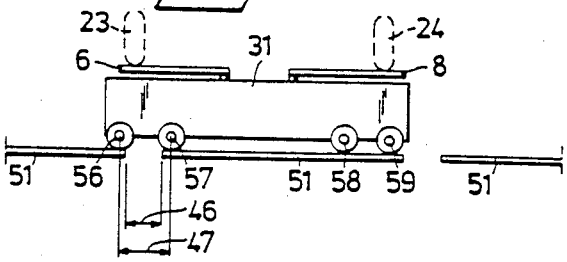
FIG. 10 illustrates a detail of the elevator shaft and a transfer carriage.

The rails 50, 51 are interrupted in the vicinity of respective elevator shafts, see FIGS. 5 and 10, so as to permit vertical passage of the lifting attachments 42–45. At each such interruption, the rail interruption distance has length 46 which is shorter than the distance 47 between the wheel axles of each of the transfer-carriage wheel pairs 52, 53; 54, 55; 56, 57; 58, 59.

This arrangement will thus enable a transfer carriage 31 whose wheels 52–59 are in their extended positions (position 55' in FIG. 2) to pass across an elevator shaft when the elevator platform is not located on a level which interferes with the transfer carriage.

When a transfer carriage is to be moved vertically, the carriage is driven into an elevator shaft and positioned centrally relative to an elevator platform. The elevator platform is then brought into abutment with the underside of the transfer carriage, whereafter the platform is caused to lift the transfer carriage slightly, so that its wheels 52–59 are free from the rails 50, 51. The wheels 52–59 of the transfer carriage are then moved to their inwardly drawn position (position 55" in FIG. 2), this position also being illustrated in FIG. 4. The transfer carriage and its wheels are therewith out of engagement with the rails 50, 51 on each floor or story of the building when transported vertically by means of the elevator arrangement.

Lifting devices of a suitable, known kind are attached to the aforesaid lifting attachments 42–45. These lifting devices may, for instance, comprise cables 48 or chains which extend over a driven drum or the like provided at the top of the elevator shaft, and connected to a counterweight. Said devices, however, may have the form of hydraulic motors attached to the lifting attachments and comprising pinion wheels which co-act with racks extending vertically along the elevator shaft. Naturally, other known elevator construction principles may also be applied.

Figure 9:
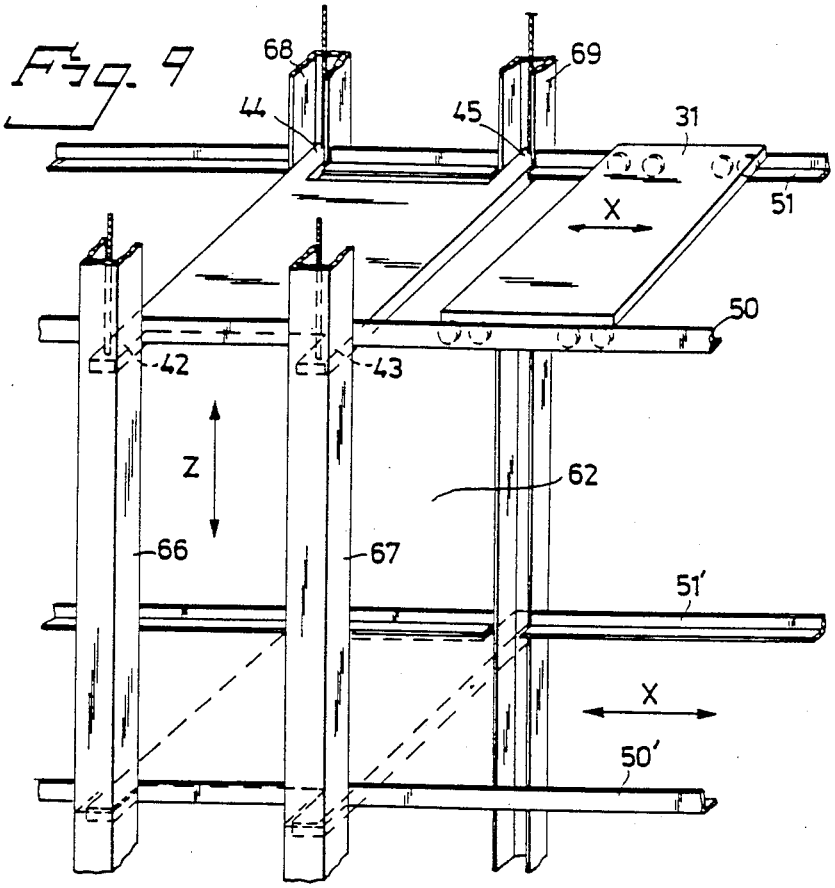
FIG. 9 is a perspective, schematic view of an elevator shaft and its associated elevator platform.

FIG. 9 illustrates schematically the principle construction of an elevator shaft, and shows two pairs of rails 50, 51; 50', 51' on different stories or floors of the building, together with a transfer carriage 31.

In accordance with a preferred embodiment, illustrated in FIG. 9, in lifting attachments 42–45 are guided for movement in vertically extending guides 66–69. These guides preferably have the form of U-beams and the lifting attachments run on the inner surfaces of the beams, supported by rollers or wheels not shown.

As before mentioned, the transport carriage is constructed for movement relative to the transfer carriage on wheels 32–35. This movement is effected in the common longitudinal direction of the transfer carriage and the transport carriage.

As will be seen from FIGS. 7 and 8, a parking building may include parking spaces 70 on both sides of the aforesaid transport carriage 71, including rails 50, 51. In other instances, parking spaces may only be provided on one side of a transport path 17. Accordingly, the transport carriage is constructed for movement in one direction or, when appropriate (as in the case of the illustrated example) in both directions, so as to be able to deliver a vehicle to or collect a vehicle from a parking space on one side of the horizontal conveyor path 71, or from either side of said conveyor path, as applicable.

As before mentioned, the wheels 32–35 of the transport carriage 30 run on rails 36–37, or corresponding elements, on the transfer carriage.

Figure 11:
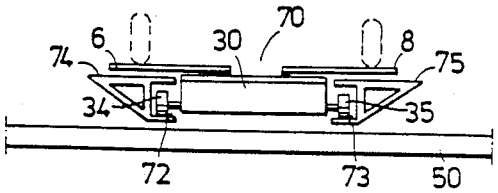
FIG. 11 illustrates schematically a transport carriage belonging to the transfer carriage and moved into position in a parking space.

FIG. 11 is a side view of a parking space, as it will be seen from the side remote from the elevator shaft. Each parking space includes a pair of rails 72, 73 which extend along the whole length of the parking space. One end of respective rails 72, 73 will connect with the rails 36, 37 on the transfer carriage, when said carriage is moved in the direction of arrow 60 to a position opposite the parking space in question.

The transport carriage can thus be drivingly displaced from the transfer carriage, into a parking space and vice-versa. FIG. 11 shows a transport carriage 30 driven into a parking space 70.

As illustrated in FIG. 11, the rails 72, 73 of the parking spaces 70 and, naturally, the rails 36, 37 of the transfer carriage 31 lie on a level which overlies the level on which the rails 50, 51 of the transport path 71 concerned are located.

Each parking space includes two bearing surfaces 74, 75 for supporting the wheels of a vehicle parked in said space. These bearing surfaces 74, 75 are located on a level which is slightly lower than the lifting blocks 1–8 on the carriages 12, 13, as illustrated in FIG. 11. The positions of respective bearing surfaces is also illustrated in chain lines in FIG. 1. A vehicle raised on the lifting blocks 1–8 of the transport carriage 30 can thus be moved in over a parking space 70, by means of the transport carriage 30, whereafter the lifting blocks of each pair are separated, so as to lower the vehicle wheels into abutment with the bearing surfaces. The transport carriage is then moved back onto the transfer carriage, while leaving the vehicle in the parking space.

When collecting a vehicle from a parking space, the transport carriage is moved into said space and the lifting blocks are extended or swung out, so as to lift the vehicle wheels. The transport carriage 30 is then moved back onto the transfer carriage 31, with the vehicle resting on the lifting blocks.

As before mentioned, the transfer carriage 31 is conveyed horizontally on the rails 50, 51 of each floor or story of the parking building.

The transfer carriage 31 is conveyed vertically by means of the elevator arrangement, in the aforedescribed manner.

Thus, a transport carriage 30 can be moved in all three directions x, y and z in a parking building.

Thus, because the aforedescribed vehicle conveying system enables a transfer carriage to be moved on a conveyor path 71 over an elevator shaft, it is possible to locate one or more elevator shafts in the parking building, as illustrated in FIGS. 6 and 7, in positions other than adjacent to the outer walls of the building.

Consequently, the average distance from the parking spaces of a particular story to an elevator shaft will be shorter than those instances when the elevator shaft is positioned adjacent the outer walls of the parking building, which is highly beneficial in the case of large, multistory car parks with regard to the time taken to deliver vehicles to and collect vehicles from respective parking spaces.

Since one or more transfer carriages can be moved around the parking building, it is only necessary to occupy the elevators during the actual vertical conveyance of a transfer carriage.

The number of transfer carriages provided will preferably be at least equal to the number of stories or floors of the parking building.

It will be understood, however, that the number of transfer carriages and elevators (lifts) required for a given parking building with a given number of stories and a given number of parking spaces per story can be calculated mathematically so as to render it unnecessary, seen statistically, for a customer to wait more than a given length of time before he is able to drive his car from the parking building.

Naturally, such a parking building will be equipped with computer controlled equipment of a suitable, known kind in order to optimize the waiting positions of the transfer carriages and also to optimize the movement plan of the transfer carriages.

For instance, a vehicle drive-in ramp and a vehicle drive-out ramp may be located adjacent each of the elevators on the street floor level 80.

When FIG. 7 is taken to illustrate a plan view of the street floor level 80, the drive-in ramps will be located at reference numerals 82 and 83, whereas the drive-out ramps will be located at reference numerals 84 and 85.

A drive-in and drive-out ramp will have the same or similar construction as the aforedescribed parking spaces.

The driver will thus drive his vehicle onto the drive-in ramp. When the requisite fee has been paid, a transfer carriage is brought to a position in front of the driven-in ramp, by means of the control equipment, whereafter the transport carriage is moved onto the drive-in ramp, the lifting blocks are extended and the vehicle wheels lifted, whereafter the transport carriage is moved back onto the transfer carriage. The transfer carriage is then moved to a vacant parking space, and there delivers the vehicle in the aforedescribed manner.

When a vehicle is to be collected, the driver of the vehicle issues an instruction to this effect to the control equipment, whereupon a transfer carriage is moved to the parking space concerned and collects the vehicle in the aforedescribed manner. The transfer carriage is then moved to a drive-out ramp, onto which the transport carriage is moved, the lifting blocks are retracted and the transport carriage is moved back onto the transfer carriage.

The driver will then, himself, drive the vehicle from the drive-out ramp.

Naturally, in addition to the drive-in and drive-out ramp on the aforesaid street level, parking spaces may also be provided on said level, on both sides of said ramps.

It will be understood that the aforesaid advantages of enabling a transfer carriage to pass an elevator shaft and the fact that the transfer carriages are not bound to any specific parking space or to any specific elevator arrangement, afford a highly flexible system with regard to the movement pattern of transfer carriages and vehicles.

It will also be understood that the aforedescribed, exemplifying embodiments can be modified in many ways. As before mentioned, the means employed for operating the elevators may be of any suitable kind known to those skilled in this art. Similarly, the construction of the elevator platform or like device can be varied and adapted to the transfer carriages concerned.

It is also possible, inter alia, to vary the position of the elevator shaft, and also the number of stories and parking spaces provided.

The transfer carriages, the transport carriages and the lifting devices provided for lifting a vehicle relative to the transport carriages may also have a construction different to that described and illustrated.

Thus, the illustrated embodiments do not restrict the scope of the present invention, since modifications can be made within the scope of the following claims.

I claim:

1. Vehicle elevator and conveyor arrangements for cars, in a multi-storied vehicle parking building of the kind in which a vehicle is moved to a parking space in said building, which includes a plurality of parking spaces, without the assistance of a driver and without being rolled, said conveyor arrangement including at least one transfer carriage which comprises a transport carriage, which in turn includes lifting devices constructed to raise and lower all wheels of the vehicle, said at least one transfer carriage being movable in a horizontal plane in the parking building and also in a vertical direction in said building by means of an elevator arrangement, which elevator arrangement includes an elevator platform for supporting a transfer carriage, characterised in that each of the floors or stories of the parking building on which a transfer carriage (31) is intended to be moved is provided with two mutually parallel rails (50, 51; 50′, 51′) which form a horizontal conveyor path (71) for said at least one transfer carriage (31), said at least one transfer carriage (31) being intended to be moved on said rails (50, 51; 50′, 51=) by means of two wheel pairs (52, 53; 54, 55; 56, 57; 58, 59) located on each side of a transfer carriage which depicts a track width of said transfer carriage; in that one or more elevator shafts (61, 62) are positioned at locations along the longitudinal extension of the rails; in that the wheels (52–59) of a transfer carriage can be moved from a position (55′) in which the track width of a transfer carriage (31) corresponds to the distance between the bearing surfaces of the rails (50, 51) to a position (55|) in which the track width of a transfer carriage is smaller than said distance; in that the elevator platform (40) includes a plate whose length (L) is shorter than the distance between said parallel rails (50, 51); in that lifting attachments (42–45) extend from the platform (40) in the longitudinal direction thereof; in that said parallel rails (50, 51) are interrupted in the vicinity of each elevator shaft (61, 62) such as to allow vertical passage of the lifting attachment (42–45); in that the longitudinal extension (46) of each interruption in the parallel rails (50, 51) is shorter than the distance between the axles of the wheels (52–59) of each wheel pair of a transfer carriage (31); and in that elevator-platform lifting devices (48) are mounted on said lifting attachment (42–45).

2. An arrangement according to claim 1, characterised in that the transport carriage (30) of the transfer carriage (31) is arranged for movement in the longitudinal direction of the transfer carriage (31), in one or both directions, so as to be able to deliver or collect a vehicle to or from a parking space (70) located on one or, when applicable, on the other side of the transfer carriage (31) concerned.

3. An arrangement according to claim 1, characterised in that the lifting attachments (42–45) move in and are guided by vertically extending guide rails (66–69).

4. An arrangement according to claim 3, wherein said vertically extending guide rails have a U-shaped cross-section.

5. An arrangement according to claim 1, characterised in that the transport carriage (30) is provided with wheels (32–35) which are intended to run on transport carriage rails (36, 37) mounted on the transfer carriage (31) and also on rails (72, 73) in each of said parking spaces (70) which are adapted to connect with transport carriage rails (36, 37).

6. An arrangement according to claim 5, characterised in that the rails (36, 37; 72, 73) for the transport carriage (30) are located on a level above the level of the rails (50, 51) of the transport path (71) concerned.

* * * * *

UNITED STATES PATENT AND TRADEMARK OFFICE

CERTIFICATE OF CORRECTION

PATENT NO. : 4,986,714

DATED : January 22, 1991

INVENTOR(S) : GÖRAN FERNSTROM

It is certified that error appears in the above-identified patent and that said Letters Patent is hereby corrected as shown below:

IN THE CLAIMS:

Column 8, line 10, "51=" should be --51'--.

, line 19, "55|" should be --55"--.

Signed and Sealed this

Twenty-third Day of June, 1992

*Attest:*

DOUGLAS B. COMER

*Attesting Officer*

*Acting Commissioner of Patents and Trademarks*